US012297581B2

(12) United States Patent
Choi et al.

(10) Patent No.: US 12,297,581 B2
(45) Date of Patent: May 13, 2025

(54) WASHING MACHINE AND METHOD OF CONTROLLING THE SAME

(71) Applicant: SAMSUNG ELECTRONICS CO., LTD., Suwon-si (KR)

(72) Inventors: Junyoung Choi, Suwon-si (KR); Dongil Back, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 371 days.

(21) Appl. No.: 17/720,815

(22) Filed: Apr. 14, 2022

(65) Prior Publication Data

US 2022/0381062 A1 Dec. 1, 2022

Related U.S. Application Data

(63) Continuation of application No. PCT/KR2022/005233, filed on Apr. 12, 2022.

(30) Foreign Application Priority Data

May 27, 2021 (KR) ..... 10-2021-0068067

(51) Int. Cl.
*D06F 39/14* (2006.01)
*D06F 33/30* (2020.01)
(Continued)

(52) U.S. Cl.
CPC ..... *D06F 39/14* (2013.01); *D06F 33/30* (2020.02); *D06F 34/20* (2020.02); *D06F 37/28* (2013.01); *D06F 2103/40* (2020.02)

(58) Field of Classification Search
CPC ..... D06F 33/30; D06F 34/20; D06F 37/28; D06F 39/14; D06F 2103/40
See application file for complete search history.

(56) References Cited

U.S. PATENT DOCUMENTS 5,823,017 A * 10/1998 Hapke ..... D06F 37/42 68/12.26
5,838,125 A 11/1998 Choi
(Continued)

FOREIGN PATENT DOCUMENTS

CN 108221279 A 6/2018
CN 109267302 A 1/2019
(Continued)

OTHER PUBLICATIONS

Machine translation of CN 109267302 A to Niu et al. (Year: 2019).*
(Continued)

*Primary Examiner* — Joseph L. Perrin
(74) *Attorney, Agent, or Firm* — STAAS & HALSEY LLP

(57) ABSTRACT

A washing machine includes a housing equipped with an inlet, a door to open or close the inlet and including a latch with a locking hole formed at the latch, a door locking device including a locking member with a locking bar formed at the locking member to be inserted to the locking hole, and configured to lock or unlock the door according to whether the locking member is fixed, an automatic door opening device to deliver driving power to the locking member so that the locking bar is removed from the locking hole, and a controller to control the door locking device to unlock the door by unfixing the locking member, in response to a completion of a washing course and to control the automatic door opening device to open the door by delivering the driving power to the locking member in response to the door being unlocked.

12 Claims, 19 Drawing Sheets

(51) Int. Cl.

| | |
|---|---|
| ***D06F 34/20*** | (2020.01) |
| *D06F 37/28* | (2006.01) |
| *D06F 103/40* | (2020.01) |

(56) References Cited

U.S. PATENT DOCUMENTS

| | | | |
|---|---|---|---|
| 2018/0363226 | A1 | 12/2018 | Gim |
| 2021/0002921 | A1 | 1/2021 | Wang |

FOREIGN PATENT DOCUMENTS

| | | | |
|---|---|---|---|
| JP | 2005-95562 | | 4/2005 |
| KR | 0160422 | B1 | 12/1998 |
| KR | 10-0182513 | | 5/1999 |
| KR | 10-1034290 | B1 | 5/2011 |
| KR | 10-1063529 | B1 | 9/2011 |
| KR | 10-1310179 | | 9/2013 |
| KR | 10-2013-0139118 | | 12/2013 |
| KR | 10-2015-0099957 | A | 9/2015 |
| KR | 10-1605752 | B1 | 3/2016 |
| KR | 10-1679783 | | 11/2016 |
| KR | 10-1708678 | B1 | 2/2017 |
| KR | 10-1855470 | | 7/2018 |
| KR | 10-1975814 | | 5/2019 |
| KR | 10-2021-0004585 | | 1/2021 |

OTHER PUBLICATIONS

Office Action dated Jun. 18, 2024 issued in European Application No. EP 22 81 1482.

International Search Report dated Jul. 28, 2022, issued in PCT/KR2022/005233.

Written Opinion dated Jul. 28, 2022, issued in PCT/KR2022/005233.

* cited by examiner

WASHING MACHINE AND METHOD OF CONTROLLING THE SAME

CROSS-REFERENCE TO RELATED APPLICATIONS

This application is a continuation application filed under 35 U.S.C. § 111 (a), of International Application PCT/KR2022/005233, filed Apr. 12, 2022, it being further noted that foreign priority benefit is based upon Korean patent application 10-2021-0068067, filed May 27, 2021, in the Korean Intellectual Property Office, the disclosures of which are incorporated by reference herein in their entireties.

BACKGROUND

1. Field

The disclosure relates to a washing machine capable of washing the laundry such as clothes.

2. Discussion of Related Art

Washing machines generally include a tub for containing water (water for washing or water for rinsing), a drum rotationally installed in the tub for accommodating clothes, and a driving motor for producing driving power to rotate the drum.

The washing machine includes a device for doing laundry by operations of clothes inside being lifted and falling along the inner wall of the drum while the cylindrical drum rotates.

The washing machine performs a washing course including a series of operations such as a course for removing stains from the clothes with water having a detergent dissolved therein, a course for rinsing bubbles or residual detergent with water (for rinsing) that does not contain the detergent, and a course for spin-drying the clothes at high speed.

After the washing machine finishes the washing course, the user usually needs to come near the washing machine to open the door by his/her hand, and the clothes may smell bad due to moisture inside when the clothes have been left inside with the door closed.

SUMMARY

Aspects of the disclosure will be set forth in part in the description which follows and, in part, will be apparent from the description, or may be learned by practice of the disclosure.

The disclosure provides a washing machine capable of automatically opening a door after completion of a washing course, thereby avoiding bad smell from the laundry due to moisture inside.

According to an embodiment of the disclosure, a washing machine includes a housing equipped with an inlet, a door to open or close the inlet and including a latch having a locking hole formed at the latch, a door locking device including a locking member with a locking bar formed at the locking member to be inserted to the locking hole and configured to lock or unlock the door according to whether the locking member is fixed, an automatic door opening device configured to deliver a driving power to the locking member so that the locking bar is removed from the locking hole, and a controller configured to control the door locking device to unlock the door by unfixing the locking member, in response to a completion of a washing course and to control the automatic door opening device to open the door by delivering the driving power to the locking member in response to the door being unlocked.

The washing machine may further include an open/close detection sensor configured to detect an opening or closing of the door, and the controller may control the automatic door opening device to open the door by delivering the driving power to the locking member in response to a state in which the door is unlocked and closed.

The controller may control the automatic door opening device to open the door by delivering the driving power to the locking member in response to the door being kept in a closed state for a preset period of time after completion of the washing course.

The controller may turn off the automatic door opening device in response to the locking bar being removed from the locking hole and the door being in an open state.

The automatic door opening device may include a driver configured to generate the driving power based on electric power supplied to the driver, a link member moveable based on the driving power generated by the driver, a rotating gear rotatable based on movement of the link member and configured to deliver rotation power to the locking member, and a micro switch configured to detect a position of the link member. The controller may be configured to turn off the automatic door opening device by stopping the supply of electric power to the driver in response to the link member being in a position where the locking bar is removed from the locking hole and the door being in an opened state.

The locking member may include a cam rotated by the rotation power delivered by the rotating gear.

The controller may turn off the automatic door opening device in response to the passage of a preset period of time after starting to control the automatic door opening device.

The washing machine may further include a communication module configured to communicate with an external terminal device, and the controller may control the automatic door opening device to open the door by delivering the driving power to the locking member in response to receiving a command to open the door from the external terminal device after the completion of the washing course.

The washing machine may further include an input module configured to receive a user input, and the controller may control the automatic door opening device to open the door by delivering the driving power to the locking member after the completion of the washing course in response to a user input being entered to activate an automatic door opening function.

The washing machine may further include a speaker, and the controller may be configured to control the speaker to output a notification sound while controlling the automatic door opening device.

According to an embodiment of the disclosure, a method of controlling a washing machine including a housing equipped with an inlet, a door to open or close the inlet and including a latch having a locking hole formed at the latch, a door locking device including a locking member with a locking bar formed at the locking member to be inserted to the locking hole and configured to lock or unlock the door according to whether the locking member is fixed, and an automatic door opening device configured to deliver a driving power to the locking member so that the locking bar is removed from the locking hole, the method including controlling the door locking device to unlock the door by unfixing the locking member, in response to a completion of a washing course; and controlling the automatic door opening device to open the door by delivering the driving power to the locking member to remove the locking bar from the locking hole in response to the door being unlocked.

The washing machine may further include an open/close detection sensor configured to detect opening or closing of the door, and the controlling of the automatic door opening device to open the door may include controlling the automatic door opening device to open the door by delivering the driving power to the locking member in response to a state in which the door is unlocked and closed.

The controlling of the automatic door opening device to open the door may include controlling the automatic door opening device to open the door by delivering the driving power to the locking member in response to the door being kept in a closed state for a preset period of time after completion of the washing course.

The method of controlling the washing machine may further include turning off the automatic door opening device in response to the locking bar being removed from the locking hole and the door being in an opened state.

The automatic door opening device may include a driver configured to generate the driving power based on electric power supplied to the driver, a link member moveable based on the driving power generated by the driver, a rotating gear rotatable based on movement of the moving of the link member and configured to deliver the rotation power to the locking member, and a micro switch configured to detect a position of the link member. The turning off of the automatic door opening device may include turning off the automatic door opening device by stopping the supply of electric power to the driver in response to the link member being in a position where the locking bar is removed from the locking hole and the door being in an opened state.

The locking member may include a cam rotated by the rotation power delivered by the rotating gear.

The controlling of the automatic door opening device to open the door may include turning off the automatic door opening device in response to the passage of a preset period of time after starting to control the automatic door opening device.

The washing machine may further include a communication module configured to communicate with an external terminal device, and the controlling of the automatic door opening device to open the door may include controlling the automatic door opening device to open the door by delivering the driving power to the locking member in response to receiving a command to open the door from the external terminal device after the completion of the washing course.

The washing machine may further include an input module configured to receive a user input, and the controlling of the automatic door opening device to open the door may include controlling the automatic door opening device to open the door by delivering the driving power to the locking member after the completion of the washing course in response to a user input being entered to activate an automatic door opening function.

The washing machine may further include a speaker, and the method of controlling the washing machine may further include controlling the speaker to output a notification sound while controlling the automatic door opening device.

BRIEF DESCRIPTION OF THE DRAWINGS

These and/or other aspects, features, and advantages of the disclosure will become more apparent to those of ordinary skill in the art by describing in detail example embodiments thereof with reference to the accompanying drawings, in which.

DETAILED DESCRIPTION

Figure 1:
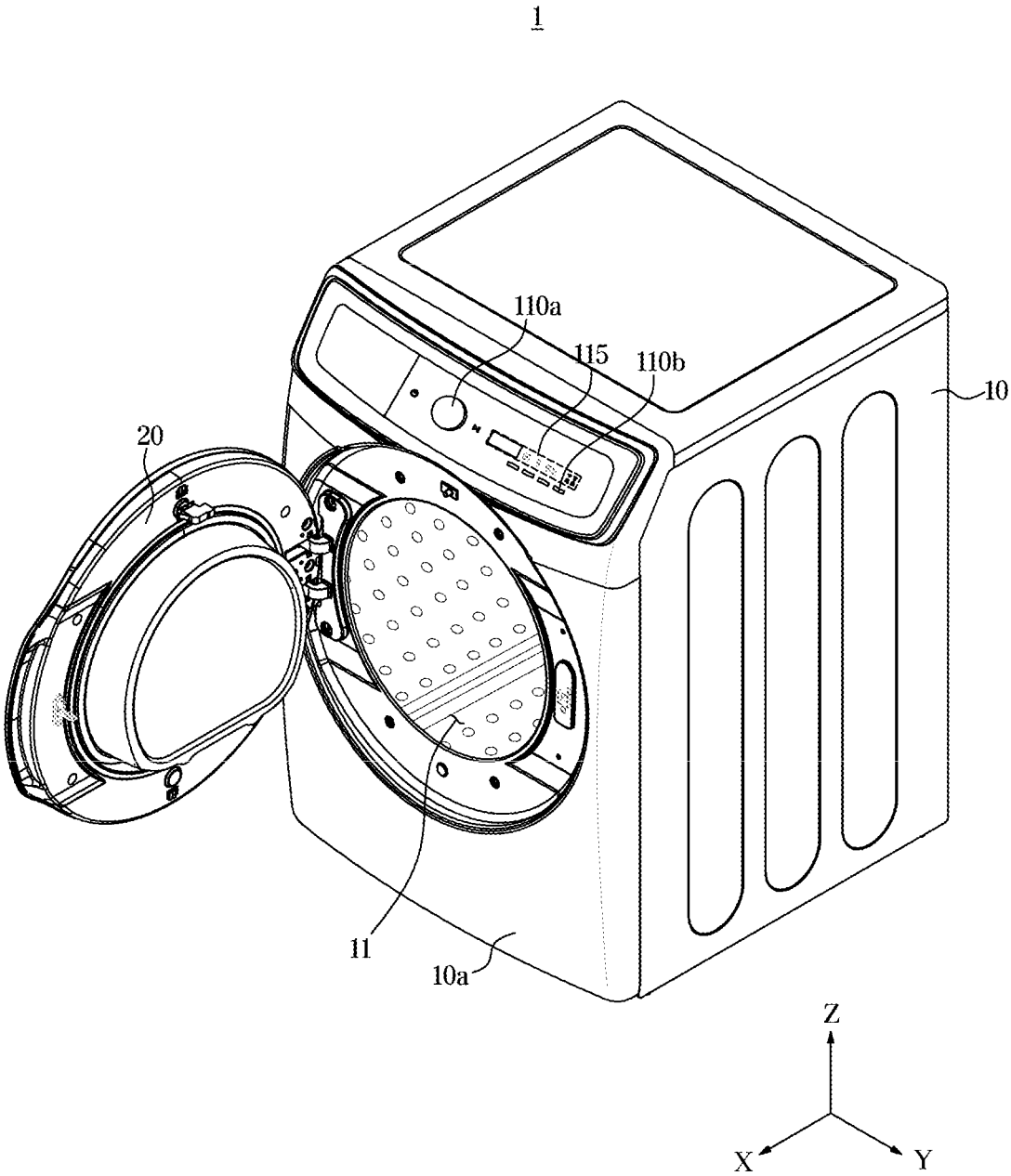
FIG. 1 is an exterior view of a washing machine, according to an embodiment of the disclosure.

Embodiments and features as described and illustrated in the disclosure are merely examples, and there may be various modifications to replace the embodiments and drawings.

It will be further understood that the term "connect" or its derivatives refer both to a direct and an indirect connection with another element interposed therebetween, and an example of the indirect connection may include a connection over a wireless communication network.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure.

Furthermore, the terms, such as part", block", member", module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method operations are merely used to identify the respective operations, but not to limit an order of the operations. Thus, unless the context clearly dictates otherwise, the written order may also be practiced otherwise.

The term "and/or" includes any combination of a plurality of related items or any one of a plurality of related items. For example, the scope of the expression or phrase "A and/or B" includes the item "A", the item "B", and the combination of items "A and B".

In addition, the scope of the expression or phrase "at least one of A and B" is intended to include all of the following: (1) at least one of A, (2) at least one of B, and (3) at least one A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

Reference will now be made in detail to embodiments of the disclosure, which are illustrated in the accompanying drawings.

Figure 2:
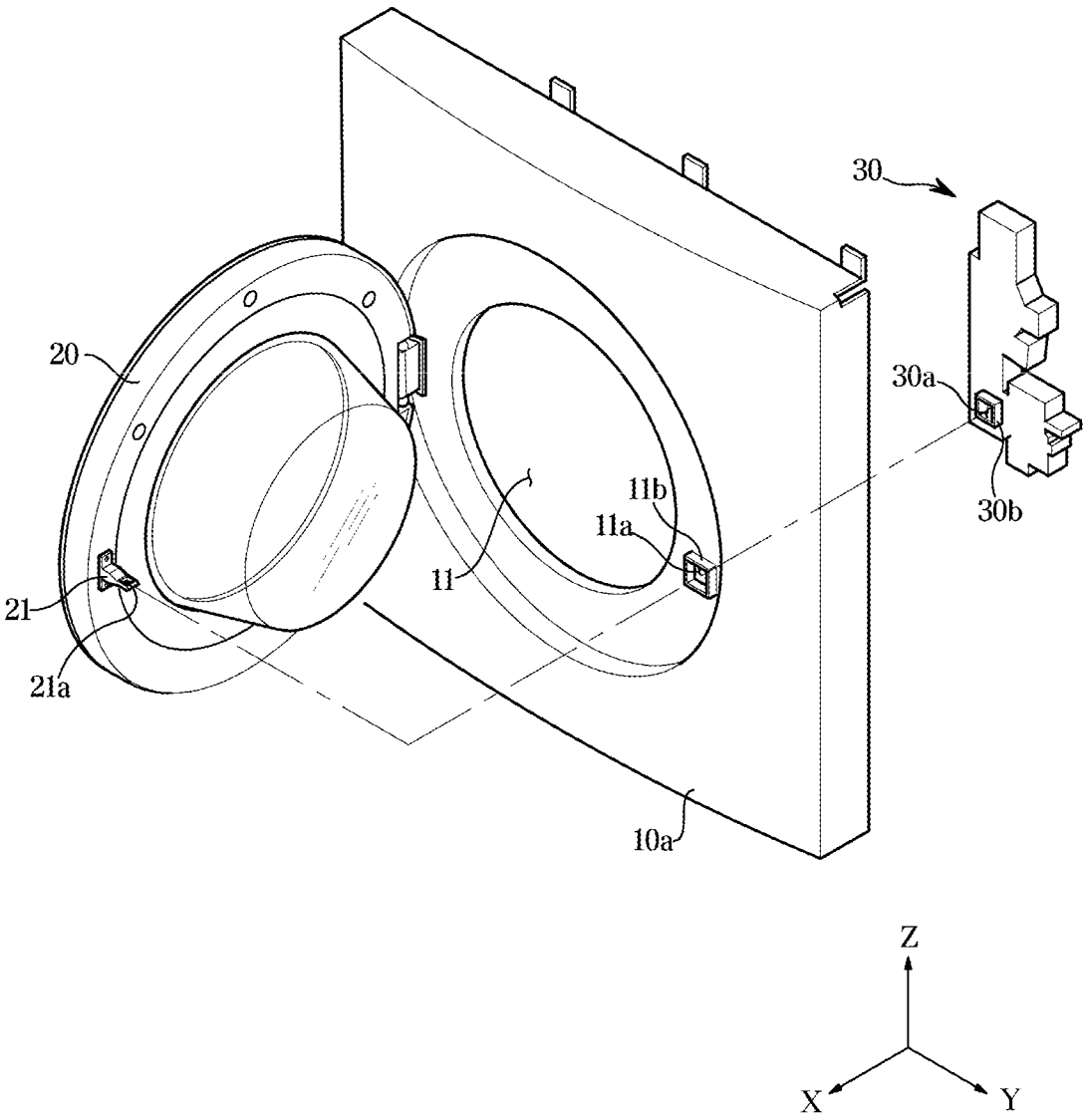
FIG. 2 is a perspective view of an installation structure of a latch of a door and a door lock switch, according to an embodiment of the disclosure.
Figure 3:
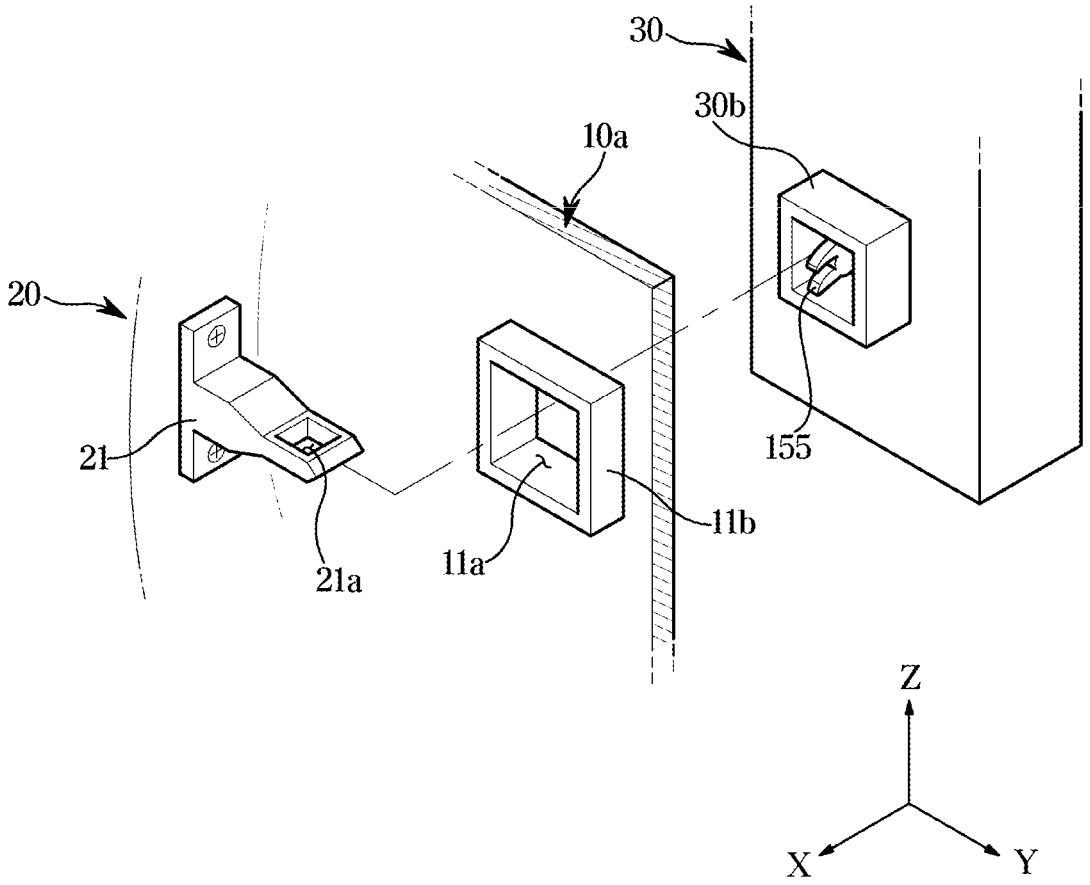
FIG. 3 is a perspective view of an installation structure of a latch of a door and a door lock switch, according to an embodiment of the disclosure.
Figure 4:
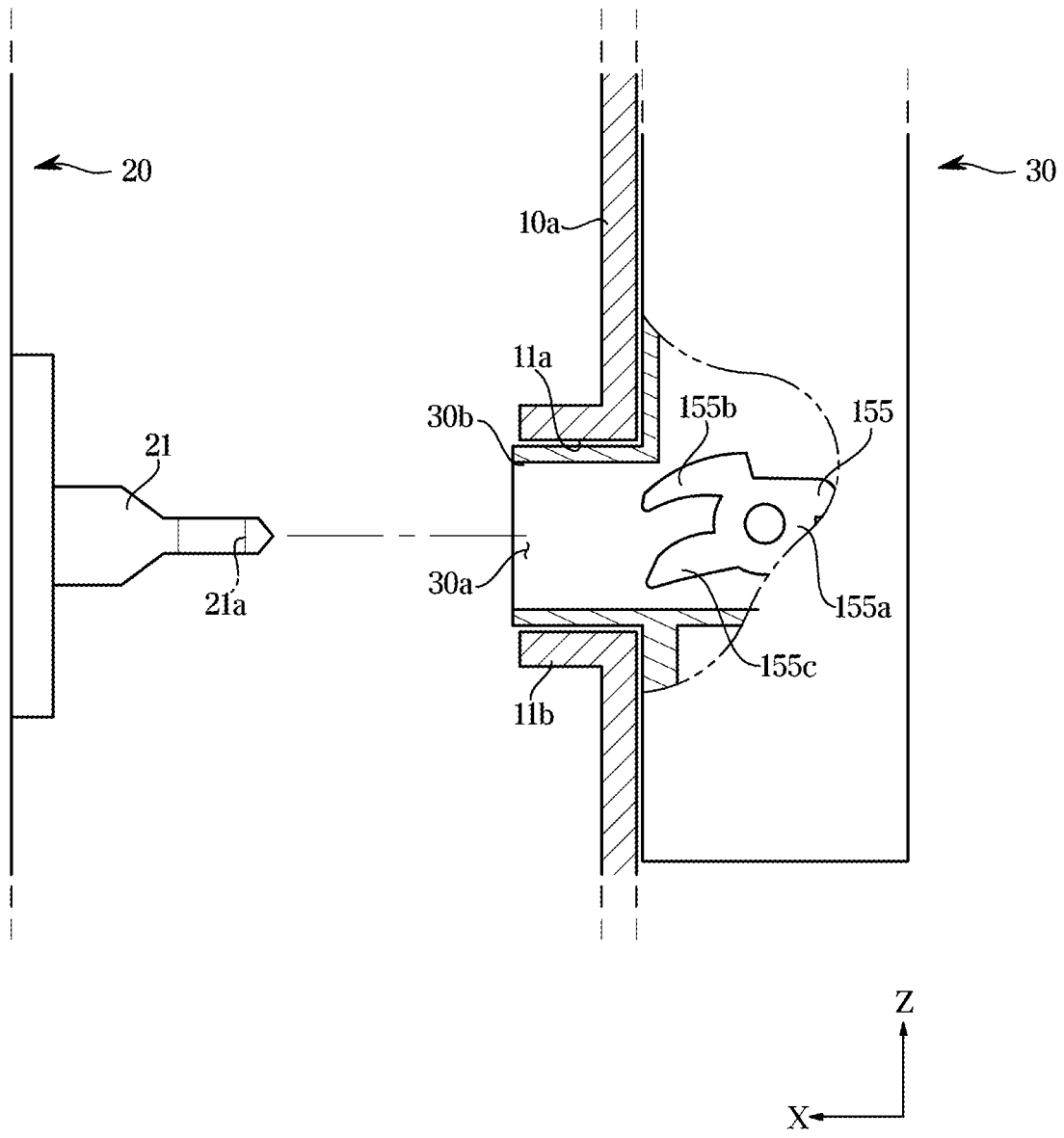
FIG. 4 is a side cross-sectional view of a latch of a door before being inserted to a door lock switch, according to an embodiment of the disclosure.
Figure 5:
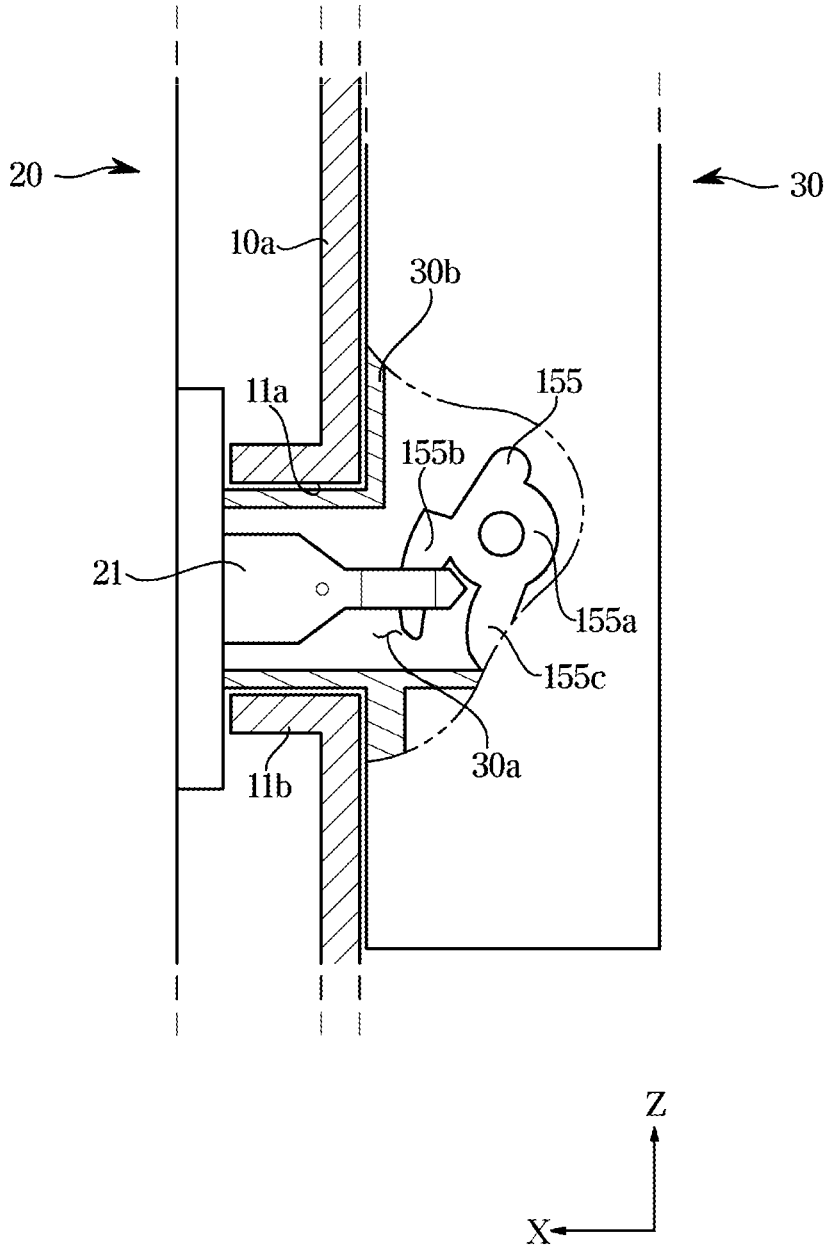
FIG. 5 is a side cross-sectional view of a latch of a door inserted to a door lock switch, according to an embodiment of the disclosure.

FIG. 1 is an exterior view of a washing machine, according to an embodiment of the disclosure, FIGS. 2 and 3 are perspective views of an installation structure of a latch of a door and a door lock switch, according to an embodiment of the disclosure, and FIG. 4 is a side cross-sectional view of a latch of a door before being inserted to a door lock switch, according to an embodiment of the disclosure. FIG. 5 is a side cross-sectional view of a latch of a door inserted to a door lock switch, according to an embodiment of the disclosure.

Referring to FIG. 1, a washing machine 1 includes a main body 10 that defines external appearance, a tub (not shown) installed in the main body 10 for storing water during a washing course, and a drum (not shown) rotationally installed in the tub and having a plurality of through holes formed thereat. The washing machine 1 performs a washing course by operations of clothes inside being lifted and falling along the inner wall of the drum while the drum rotates. In this regard, the washing machine 1 may include a driving motor (not shown) for generating driving power to rotate the drum and a water supplier (not shown) for supplying water into the tub.

At a front cover 10*a* of the main body 10, an inlet 11 may be formed to allow clothes to be thrown into the drum and a door 20 may be installed to open or close the inlet 11.

An input module 110 (see FIG. 9) for receiving control commands from the user and a display 115 for displaying a screen to present various information about operations of the washing machine 1 or guide the user to enter an input may be arranged in an upper portion of the front cover 10*a*.

The input module 110 may be provided as a jog shuttle or in the form of a dial, allowing the user to hold and turn or press the input module 110*a* to enter a control command, or provided as a touch pad or buttons, allowing the user to touch or press the input 110*b* to enter a control command.

The user may enter an operation command to perform a washing course through the input module 110, and may enter a user input to activate an automatic door opening function according to an embodiment of the disclosure as will be described later.

Referring to FIGS. 2 and 3, one side of the door 20 is mounted at one side of the inlet 11 of the front cover 10*a* so that the door 20 is able to pivot on the side.

A latch 21 is installed on the other side and the rear surface of the door 20 to protrude rearwards to keep the inlet 11 closed by the door 20, and a door lock switch 30 is installed on the rear surface of the front cover 10*a* of the main body 10 to keep the inlet 11 closed by the door 20 by locking the latch 21.

A locking hole 21*a* is formed at a rear end side of the latch 21 to catch the door lock switch 30, so that a structure such as a locking member 155 included in the door lock switch 30 is caught in the locking hole 21*a* when the rear end of the latch 21 is inserted to the door lock switch 30. Accordingly, locking is made.

A first through hole 30*a* is formed at the door lock switch 30 to allow the rear end of the latch 21 to pass through the front of the door lock switch 30 and be inserted to the inside of the door lock switch 30, and a second through hole 11*a* is formed at the inlet 11 of the front cover 10*a* in a position matching the first through hole 30*a* to allow the latch 21 to pass through the front cover 10*a* and be inserted to the door lock switch 30.

The first through hole 30*a* and the second through hole 11*a* need to be positioned to exactly match each other so that the rear end of the latch 21 may pass through the first and second through holes 30*a* and 11*a* and may be inserted to the inside of the door lock switch 30. Hence, a first supporting part 30*b* is formed on the door lock switch 30 to integrally extend from a portion near the first through hole 30*a*, and supported by the inner walls of the second through hole 11*a*. Furthermore, a second supporting part 11*b* may be formed to integrally extend from a portion near the second through hole 11*a*.

Referring to FIGS. 4 and 5, the locking member 155 of the door lock switch 30 may be positioned for the latch 21 of the door 20 to be inserted thereto before the latch 21 is inserted to the door lock switch 30.

For example, the locking member 155 may be provided as a cam that is able to rotate according to rotation power, and may include a cam main body 155*a*, a locking bar 155*b* provided to protrude from the cam main body 155*a* to be inserted to the locking hole 21*a*, and an auxiliary bar 155*c* arranged to protrude from the cam main body 155*a* to deliver rotation power to the cam main body 155*a* when the latch 21 is inserted to the door lock switch 30.

The locking bar 155*b* and the auxiliary bar 155*c* may be arranged to face each other at a certain distance between them. The door lock switch 30 is arranged such that an empty space between the locking bar 155*b* and the auxiliary bar 155*c* faces the first through hole 30*a* before the latch 21 is inserted to the door lock switch 30 to allow the latch 21 to be inserted to the empty space between the locking bar 155*b* and the auxiliary bar 155*c*.

As shown in FIG. 5, when the latch 21 is inserted to the door lock switch 30, the locking member 155 is rotated, causing the locking bar 155*b* of the locking member 155 to be inserted to the locking hole 21*a* of the latch 21, so that inlet 11 may be kept closed by the door 20.

For example, when the latch 21 is inserted to the door lock switch 30 through the first through hole 30*a*, a front end portion of the latch 21 may pressurize the auxiliary bar 155*c*, and the pressure on the auxiliary bar 155*c* may cause the locking member 155 to be rotated and the locking bar 155*b* to be inserted to the locking hole 21*a* of the latch 21.

For example, when the user throws in clothes through the inlet 11 and pressurizes the door 20 for a washing course, the latch 21 of the door 20 is inserted to the first through hole 30*a* of the door lock switch 30 and the locking bar 155*a* of the locking member 155 is inserted to the locking hole 21*a* of the latch 21, and the door 20 may thus close the inlet 11.

Figure 6:
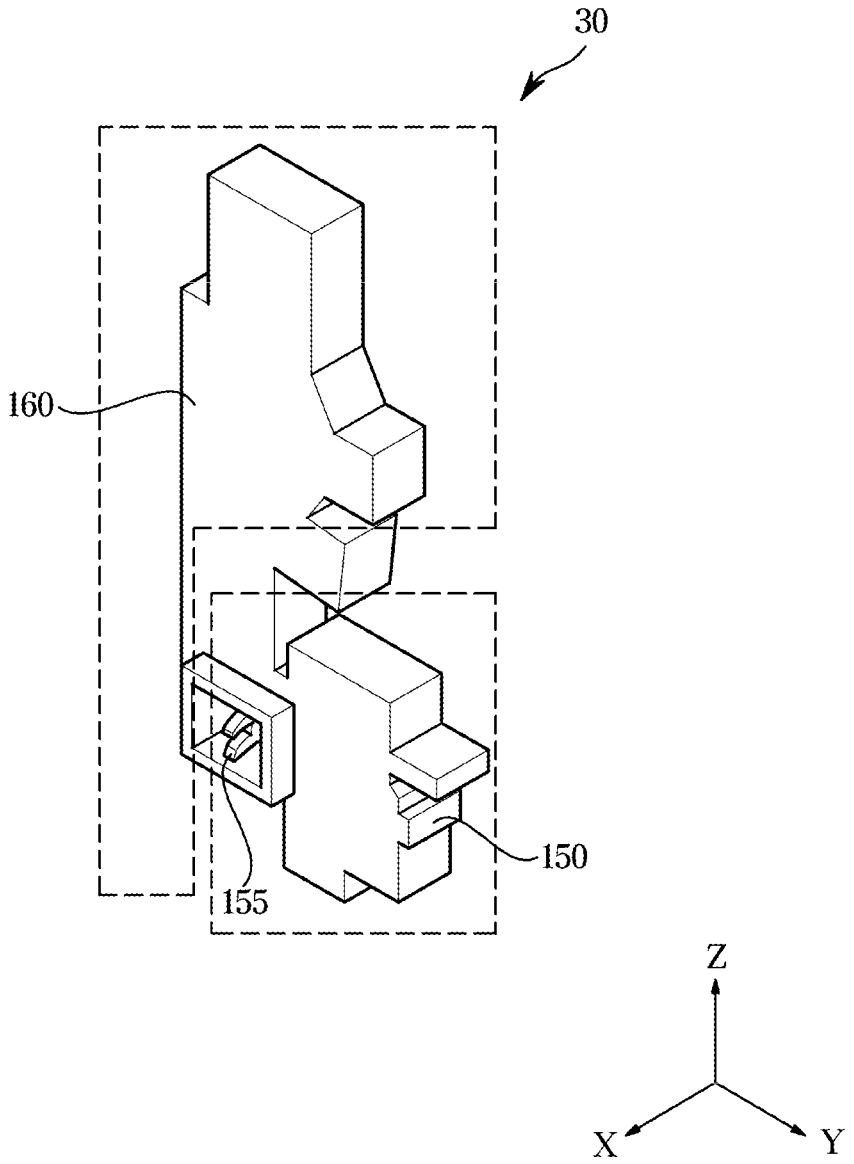
FIG. 6 is an exterior view of a door lock switch, according to an embodiment of the disclosure.
Figure 7:
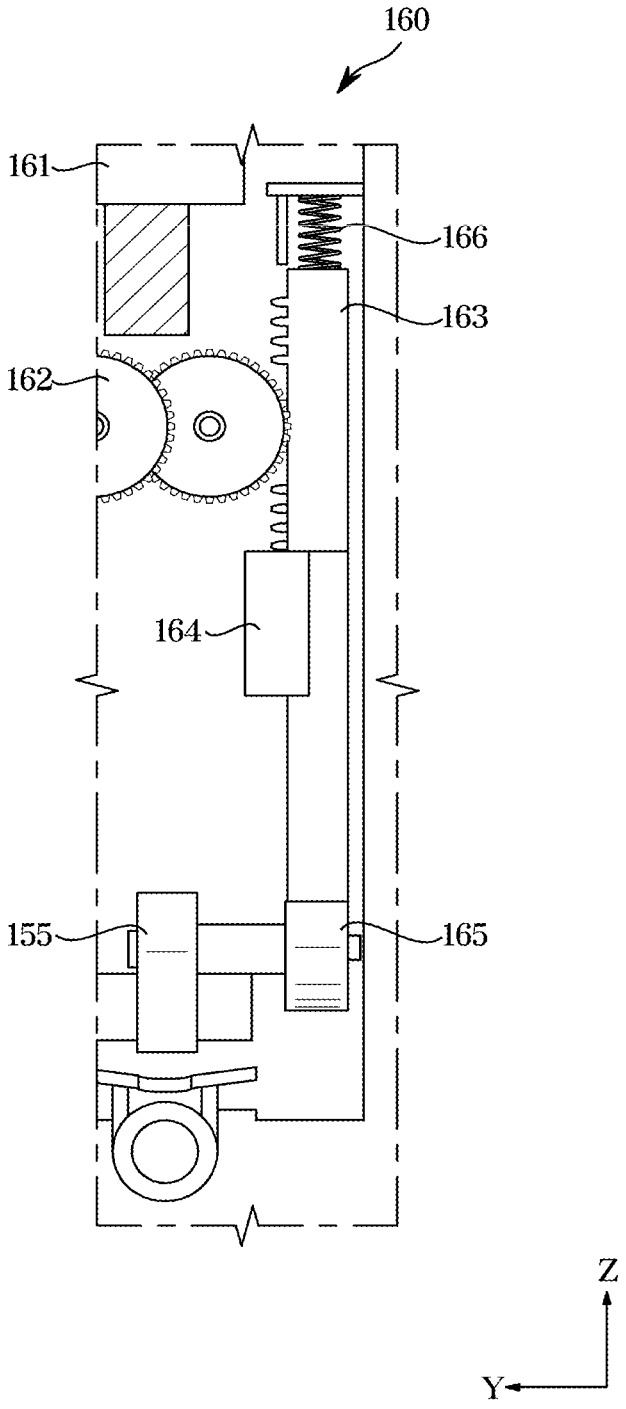
FIG. 7 is an interior view of an automatic door opening device, according to an embodiment of the disclosure.
Figure 8:
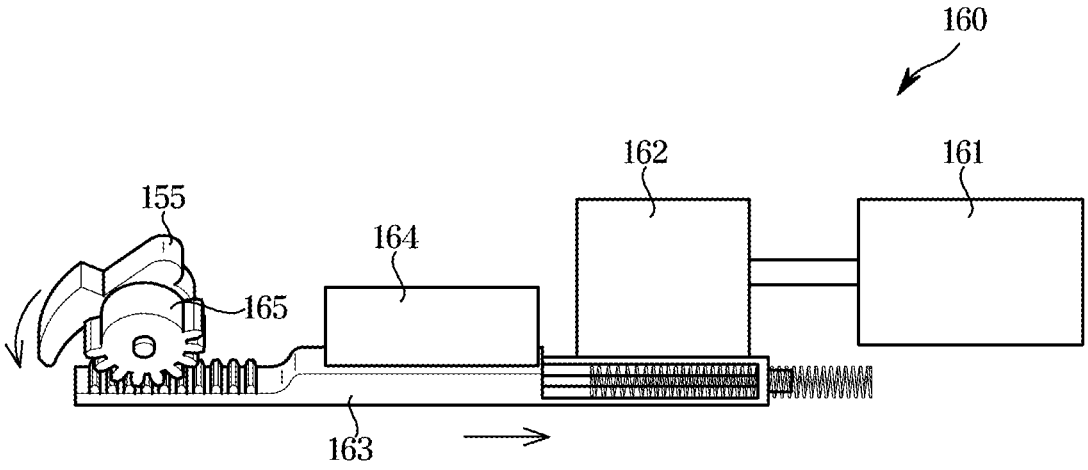
FIG. 8 illustrates an automatic door opening operation performed by an automatic door opening device, according to an embodiment of the disclosure.

FIG. 6 is an exterior view of the door lock switch 30, according to an embodiment of the disclosure, FIG. 7 is an interior view of an automatic door opening device, according to an embodiment of the disclosure, and FIG. 8 illustrates an operation of automatically opening the door 20, which is performed by an automatic door opening device, according to an embodiment of the disclosure.

Referring to FIG. 6, in an embodiment of the disclosure, the door lock switch 30 may include the locking member 155, the door locking device 150 that locks or unlocks the door 20 based on whether the locking member 155 is fixed, and the automatic door opening device 160 that may deliver driving power to the locking member 155 to open the door 20.

The door locking device 150 may lock the door 20 by fixing the locking member 155 while the latch 21 of the door 20 is inserted to the door lock switch 30. For this, the door locking device 150 may include a fixing device (not shown) that may fix the locking member 155.

For example, the door locking device 150 may lock the door 20 by fixing the locking member 155 when the latch 21 of the door 20 is inserted to the door lock switch 30 and the locking bar 155*b* of the locking member 155 is inserted to the locking hole 21*a* of the latch 221.

For example, the washing machine 1 may keep the door 20 closed while a washing course is performed by controlling the door locking device 150 to lock the door 20 to prevent the door 20 from being opened by the user during the washing course.

Furthermore, the door locking device 150 may unlock the door 20 by unfixing the locking member 155 while the latch 21 of the door 20 is inserted to the door lock switch 30.

In this case, when the user pressurizes the door 20 to open the door 20, the locking member 155 is rotated such that the locking bar 155*b* of the locking member 155 is removed from the locking hole 21*a* of the latch 21, thereby enabling the door 20 to be opened.

For example, the washing machine 1 may control the door locking device 150 to unlock the door 20 for the door 20 to be opened by the user while the washing course is finished.

Furthermore, the door lock switch 30 may include the automatic door opening device 160 capable of automatically opening the door in addition to the door locking device 150 that locks or unlocks the door 20.

In an embodiment of the disclosure, the automatic door opening device 160 enables the door 20 to be opened by delivering driving power to the locking member 155 to be rotated so that the locking bar 155*b* of the locking member 155 is removed from the locking hole 21*a* of the latch 21.

For example, the automatic door opening device 160 may include a driver 161 for generating driving power based on power supplied, a link member 163 that is moved by the driving power of the driver 161, and a rotating gear 165 that is rotated according to the motion of the link member 163 to deliver the rotation power to the locking member 155.

The driver 161 may generate driving power by receiving electric power under the control of a controller, which will be described later, and the driving power of the driver 161 may be delivered to the link member 163 through the gear member 162.

The link member 163 may deliver the driving power of the driver 161 to the rotating gear 165 coupled to the locking member 155, and a micro switch 164 may be arranged at one side of the link member 163 for detecting a position of the link member 163. A return spring 166 may be arranged at a rear end of the link member 163 for providing repulsive power for the link member 163 to go back to the original position after the link member 163 is moved by the driving power of the driver 161.

The rotating gear 165 may be physically coupled to the locking member 155, and rotated by movement of the link member 163 to deliver the rotation power to the locking member 155. The locking member 155 may be rotated based on the rotation power delivered from the rotating gear 165, so that the locking bar 155*b* of the locking member 155 is removed from the locking hole 21*a* of the latch 21 and the auxiliary bar 155*c* pushes the latch 21 out of the first through hole 30*a*, thereby enabling the door 20 to be opened.

A structure of the washing machine 1 has thus far been described in detail. An embodiment in which the washing machine 1 opens the door 20 after finishing a washing course will now be described in detail.

Figure 9:
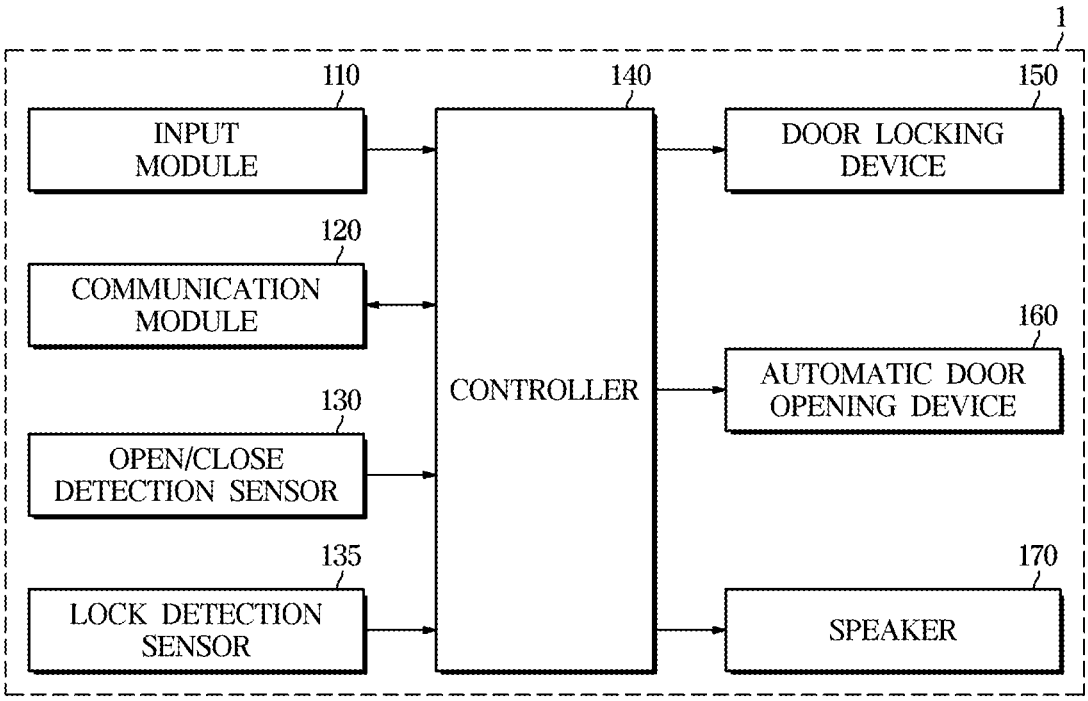
FIG. 9 is a control block diagram of a washing machine, according to an embodiment of the disclosure.
Figure 10:
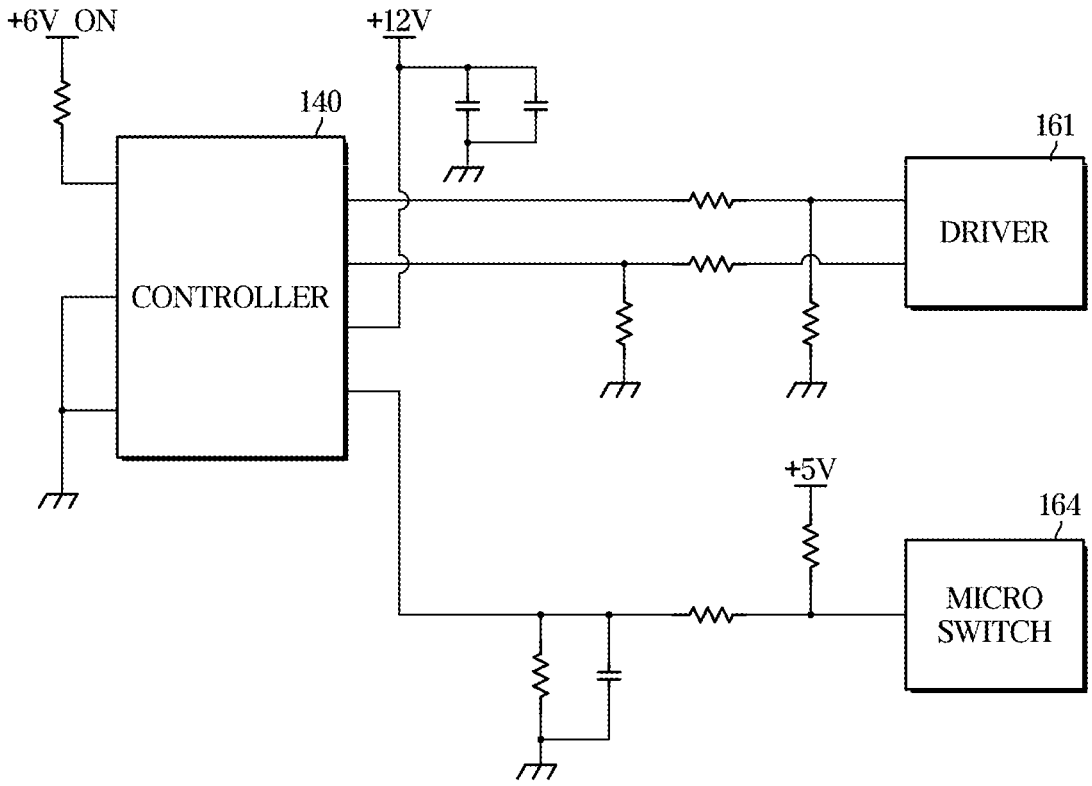
FIG. 10 is a schematic circuit diagram of a washing machine, according to an embodiment of the disclosure.

FIG. 9 is a control block diagram of the washing machine 1, according to an embodiment of the disclosure, and FIG. 10 is a schematic circuit diagram of the washing machine 1, according to an embodiment of the disclosure.

Referring to FIGS. 9 and 10, the washing machine 1 may include the input module 110 that receives a user input, a communication module 120 that communicates with an external device, an open/close detection sensor 130 that detects whether the door 20 is opened or closed, a lock detection sensor 135 that detects whether the door 20 is locked, a controller 140 that controls opening of the door 20 after a washing course is finished, the door locking device 150 that locks or unlocks the door 20 while the door 20 is closed, the automatic door opening device 160 that is able to open the door 20, and a speaker 170 that is able to output a notification sound.

The input module 110 may receive an operation command for a washing course, and the washing machine 1 may perform the washing course based on the operation command entered through the input module 110.

The input module 110 may also receive a user input to activate an automatic door opening function from the user. When receiving the user input to activate the automatic door opening function through the input module 110, the washing machine 1 may control the automatic door opening device 160 to open the door 20 after the washing course is finished.

The communication module 120 may communicate with an external terminal device (not shown).

For example, the communication module 120 may receive a door opening command from the external terminal device. In this case, the washing machine 1 may control the automatic door opening device 160 to open the door 20 in response to receiving the door opening command from the external terminal device after the washing course is finished.

The communication module 120 may be provided as a wireless communication module of a type known to the public, to perform wireless communication with the external terminal device.

The open/close detection sensor 130 may detect opening or closing of the door 20. The open/close detection sensor 130 may output a signal indicating a closed state of the door 20 while the door 20 closes the inlet 11, and may output a signal indicating an opened state of the door 20 while the door 20 opens the inlet 11.

For example, the open/close detection sensor 130 may be provided as a piezoelectric sensor arranged on one side of the door 20 or the inlet 11 to detect contact between the door 20 and the inlet 11. Position and type of the open/close detection sensor 130 are not, however, limited thereto, as long as they allow detection of whether the door 20 is opened or closed.

The open/close detection sensor 135 may detect whether the door 20 is locked or unlocked by the door locking device 150.

The lock detection sensor 135 may output a signal indicating a locked state of the door 20 when the door 20 is locked with the locking member 155 fixed while the latch 21 of the door 20 is inserted to the door lock switch 30, and may output a signal indicating an unlocked state of the door 20 when the door 20 is unlocked with the locking member 155 unfixed while the latch 21 of the door 20 is inserted to the door lock switch 30.

For example, the lock detection sensor 135 may be provided as a piezoelectric sensor arranged on one side of the door locking device 150 to detect contact between the door 20 and the door locking device 150 (fixing device). The position and type of the lock detection sensor 135 are not, however, limited thereto, as long as they allow detection of whether the door 20 is locked.

The controller 140 may control the automatic door opening device 160 to open the door 20 after washing is finished.

For example, the controller 140 may control the door locking device 150 to unlock the door 20 by unfixing the locking member 155 in response to completion of the washing course, and control the automatic door opening device 160 to open the door 20 by delivering driving power to the locking member 155 in response to unlocking of the door 20.

More specifically, to control the automatic door opening device 160 to open the door 20, the controller 140 may apply electric power to the driver 161 by applying external power (e.g., 12 V) across two electrodes of the driver 161 of the automatic door opening device 160, as shown in FIG. 10.

Accordingly, the washing machine 1 may prevent a bad smell from the laundry caused by residual moisture inside due to the closed state of the door 20 after completion of washing.

In this case, the controller 140 may turn off the automatic door opening device 160 by blocking power to the driver 161 of the automatic door opening device 160 in response to a state in which the locking bar 155*b* is removed from the locking hole 21*a* and the door 20 is opened.

For example, the controller 140 may identify a position of the link member 163 by receiving an output of the micro switch 164, as shown in FIG. 10, and may turn off the automatic door opening device 160 by stopping the supply of power to the driver 161 in response to a state in which the link member 163 has made maximum displacement so that the locking bar 155*b* is in a position to be removed from the locking hole 21*a* and the door 20 is opened.

Furthermore, the controller 140 may turn off the automatic door opening device 160 in response to the passage of a preset period of time after starting to control the automatic door opening device 160 to open the door 20. For example, the controller 140 may turn off the automatic door opening device 160 even with an error in the output of the micro switch 164 and output of the open/close detection sensor 130 by turning off the automatic door opening device 160 when a period of operation time of the automatic door opening device 160 programmed for opening the door 20 has passed after starting to control the automatic door opening device 160.

The controller 140 may control the automatic door opening device 160 to open the door 20 by delivering driving power to the locking member 155 in response to a state in which the door 20 is unlocked and closed.

For example, the controller 140 may control the automatic door opening device 160 to open the door 20 when the door 20 is unlocked but still closed after completion of washing base on outputs of the open/close detection sensor 130 and the lock detection sensor 135.

Furthermore, the controller 140 may control the automatic door opening device 160 to open the door 20 by delivering driving power to the locking member 155 in response to the door 20 kept closed for a preset period of time after completion of the washing course.

In other words, the controller 140 may control the automatic door opening device 160 to open the door 20 to prevent moisture inside from causing a bad smell from the laundry in a case that the user has not opened the door 20 for a preset period of time after the washing course was finished.

Furthermore, the controller 140 may control the automatic door opening device 160 to open the door 20 by delivering driving power to the locking member 155 in response to receiving a command to open the door 20 from an external terminal device through the communication module 120 after completion of the washing course. In other words, the controller 140 may control the automatic door opening device 160 to open the door 20 when receiving a door opening command from a user terminal after the washing course is finished.

Moreover, only when receiving a user input to activate the automatic door opening function through the input module 110, the controller 140 may control the automatic door opening device 160 to open the door 20 after the washing course is finished.

In addition, the controller 140 may control the automatic door opening device 160 to open the door 20 and simultaneously control the speaker 170 to output a notification sound. Accordingly, the washing machine 1 may notify the user of completion of washing while canceling noise that may occur during the operation of opening the door 20.

The controller 140 may include at least one memory for storing a program for carrying out the aforementioned and following operations, and at least one processor for executing the program.

The control configuration of the washing machine 1 has thus far been described in detail. An embodiment in which the washing machine 1 opens the door 20 after finishing a washing course will now be described in detail.

Figure 11:
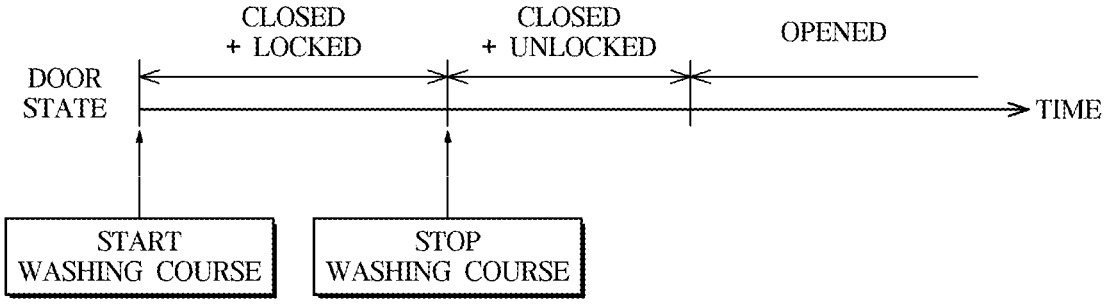
FIG. 11 illustrates a case of opening a door after a washing machine completes a washing course, according to an embodiment of the disclosure.
Figure 12:
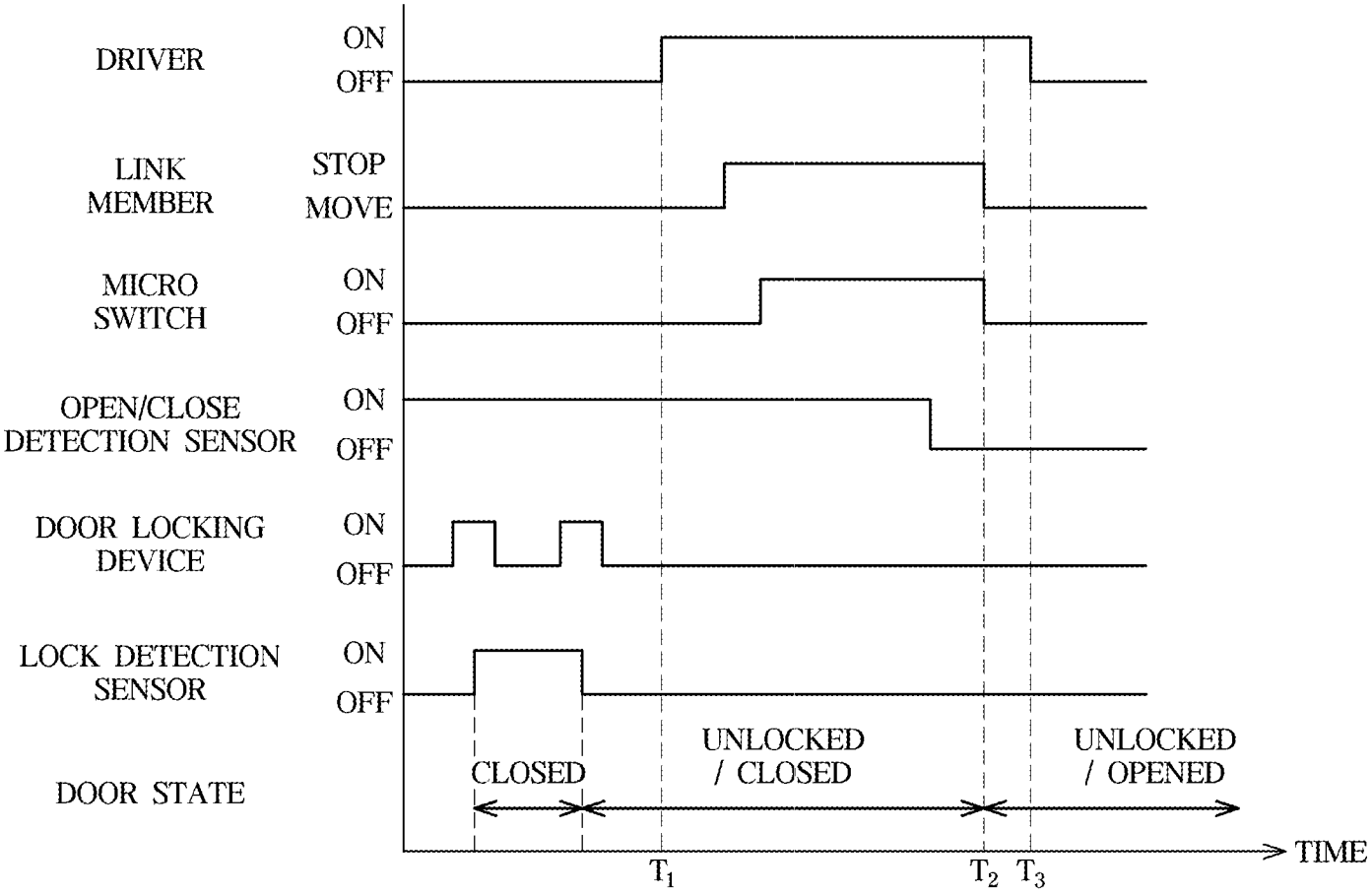
FIG. 12 is a timing diagram in a case of opening a door after a washing machine completes a washing course, according to an embodiment of the disclosure.

FIG. 11 illustrates a case of opening the door 20 after the washing machine 1 completes a washing course, according to an embodiment of the disclosure, and FIG. 12 is a timing diagram in a case of opening the door 20 after the washing machine 1 completes a washing course, according to an embodiment of the disclosure.

Referring to FIG. 11, the washing machine 1 may open the door 20 after completing a washing course.

For example, the washing machine 1 may control the door locking device 150 to lock the door 20 when a washing course is started while the door 20 is closed. In this case, the door locking device 150 may fix the locking member 155 with the locking bar 155*b* of the locking member 155 inserted to the locking hole 21*a* of the latch 21. Accordingly, the door 20 may be closed and locked during the washing course of the washing machine 1, thereby preventing the door 20 from being opened during the washing course.

The washing machine 1 may unlock the door 20 when the washing course is finished. For example, the washing machine 1 may control the door locking device 150 to unlock the door 20 when the washing course is finished. In this case, the door locking device 150 may unlock the locking member 155, so that the locking member 155 may be rotated by external pressure. The user may then open the door 20, or the door 20 may be opened by the automatic door opening device 160.

The washing machine 1 may control the automatic door opening device 160 to open the door 20 in response to the door 20 being unlocked and closed after the washing course is finished.

In other words, the washing machine 1 may control the automatic door opening device 160 to open the door 20 by delivering driving power to the locking member 155 in response to unlocking of the door 20.

For example, when the washing machine 1 identifies based on an output of the lock detection sensor 135 that the door 20 is unlocked and identifies based on an output of the open/close detection sensor 130 that the door 20 is closed, the washing machine 1 may supply power to the driver 161 at point T1, as shown in FIG. 12. In other words, the washing machine 1 may control the automatic door opening device 160 to open the door 20 when the door 20 is unlocked but still closed after completion of washing base on outputs of the open/close detection sensor 130 and the lock detection sensor 135.

The driver 161 may generate driving power based on electric power supplied, and the link member 163 may be moved by the driving power of the driver 161 delivered through the gear member 162. In this case, the micro switch 164 may output a value of 'ON' based on the movement of the link member 163, and the controller 140 may identify displacement of the link member 163 based on the output of the micro switch 164.

The rotating gear 165 may be rotated by the movement of the link member 163 and may deliver the rotation power to the locking member 155, and the locking member 155 may be rotated by the rotation power delivered from the rotating gear 165 so that the locking bar 155*b* of the locking member 155 is removed from the locking hole 21*a* of the latch 21 and the auxiliary bar 155*c* pushes the latch 21 out of the first through hole 30*a*, thereby enabling the door 20 to be opened.

The washing machine 1 may turn off the automatic door opening device 160 by blocking electric power to the driver 161 of the automatic door opening device 160 in response to a state in which the locking bar 155*b* is removed from the locking hole 21*a* and the door 20 is opened.

For example, as shown in FIG. 12, the washing machine 1 may turn off the automatic door opening device 160 at point T3 by stopping supplying electric power to the driver 161 in response to a state at point T2 in which the link member 163 has made maximum displacement so that the locking bar 155*b* is in a position to be removed from the locking hole 21*a* and the door 20 is opened, as shown in FIG. 12.

More specifically, when the washing machine 1 identifies based on the output of the micro switch 164 that the link member 163 is no longer in motion, the washing machine 1 may determine that the link member 163 has made the maximum displacement and the locking bar 155*b* is in a position to be removed from the locking hole 21*a* and that the door 20 is opened based on the output of the open/close detection sensor 130.

Furthermore, the washing machine 1 may turn off the automatic door opening device 160 in response to the passage of a preset period of time, e.g., 7.5 sec, after starting to control the automatic door opening device 160 to open the door 20. For example, the controller 140 may turn off the automatic door opening device 160 even with an error in the output of the micro switch 164 and output of the open/close detection sensor 130 by turning off the automatic door opening device 160 when a period of operation time, e.g., 4 sec, of the automatic door opening device 160 programmed for opening the door 20 has passed after starting to control the automatic door opening device 160.

As such, the washing machine 1 may open the door 20 when the door 20 is not opened by the user after completion of a washing course, thereby preventing a bad smell from the laundry caused by residual moisture inside due to the closed state of the door 20.

Figure 13:
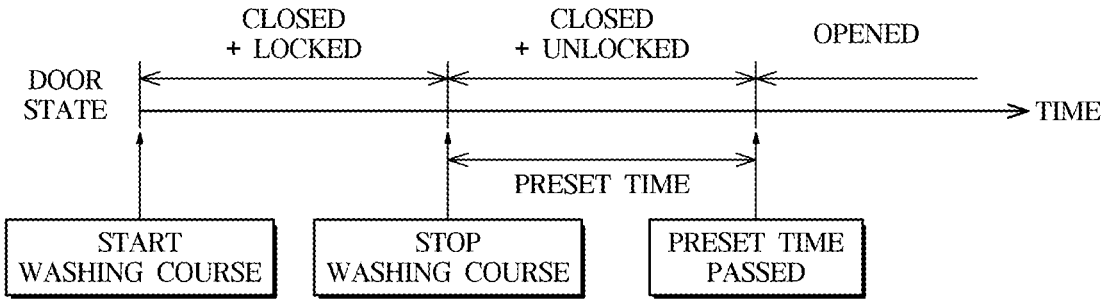
FIG. 13 illustrates a case of opening a door when a preset period of time elapses after a washing machine completes a washing course, according to an embodiment of the disclosure.

FIG. 13 illustrates a case of opening the door 20 when a preset period of time elapses after the washing machine 1 completes a washing course, according to an embodiment of the disclosure.

Referring to FIG. 13, the washing machine 1 may control the automatic door opening device 160 to open the door 20 by delivering driving power to the locking member 155 in response to the door 20 kept closed for a preset period of time after completion of the washing course.

In other words, the washing machine 1 may control the automatic door opening device 160 to open the door 20 to prevent moisture inside from causing a bad smell from the laundry in a case that the user has not opened the door 20 for a preset period of time after the washing course was finished.

For example, the washing machine 1 may control the door locking device 150 to unlock the door 20 by unfixing the locking member 155 in response to completion of the washing course, and control the automatic door opening device 160 to open the door 20 in response to the door 20 kept closed for a preset period of time after completion of the washing course.

Figure 14:
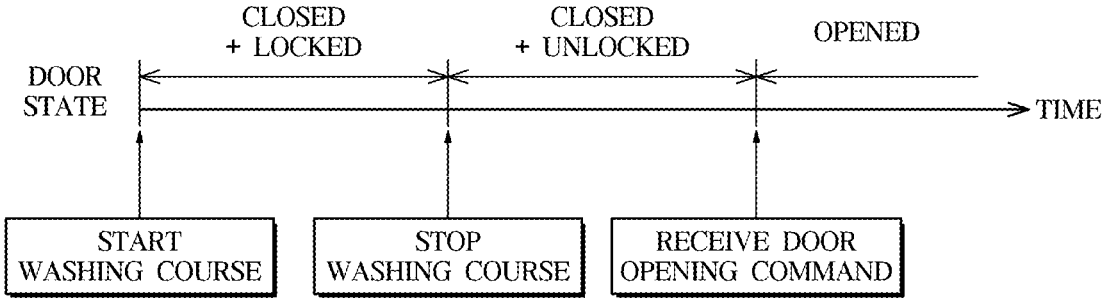
FIG. 14 illustrates a case of opening a door when a command to open a door is received from an external terminal device after a washing machine completes a washing course, according to an embodiment of the disclosure.

FIG. 14 illustrates a case of opening the door 20 when a command to open the door 20 is received from an external terminal device after the washing machine 1 completes a washing course, according to an embodiment of the disclosure.

Referring to FIG. 14, the washing machine 1 may control the automatic door opening device 160 to open the door 20 by delivering driving power to the locking member 155 in response to receiving a command to open the door 20 from an external terminal device through the communication module 120 after completion of the washing course.

For example, the washing machine 1 may control the automatic door opening device 160 to open the door 20 when receiving a door opening command from the user terminal after completion of a washing course, and accordingly, the user may remotely control the washing machine 1 to open the door 20 when a washing course is finished, thereby preventing a bad smell from the laundry caused by residual moisture due to the closed state of the door 20.

More specifically, the washing machine 1 may control the door locking device 150 to unlock the door 20 by unfixing the locking member 155 in response to completion of the washing course, and control the automatic door opening device 160 to open the door 20 in response to receiving the door opening command from the external terminal device.

Figure 15:
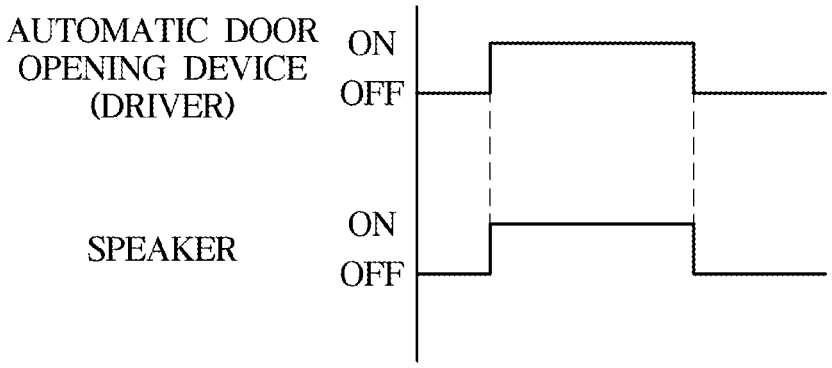
FIG. 15 illustrates a case of outputting a notification sound when a door of a washing machine is opened, according to an embodiment of the disclosure.

FIG. 15 illustrates a case of outputting a notification sound when the washing machine 1 opens the door 20, according to an embodiment of the disclosure.

Referring to FIG. 15, the washing machine 1 may control the automatic door opening device 160 to open the door 20 and simultaneously control the speaker 170 to output a notification sound.

For example, the washing machine 1 may control the speaker 170 to output a notification sound while electric power is supplied to the driver 161 of the automatic door opening device 160, so that the notification sound may offset noise that may occur during the operation of opening the door 20 and simultaneously notify the user of completion of washing.

A method of controlling the washing machine 1 will now be described in accordance with an embodiment of the disclosure. As for the method, the washing machine 1 in the aforementioned embodiments of the disclosure may be used. Hence, what are described above with reference to FIGS. 1 to 15 may be equally applied in the following method of controlling the washing machine 1.

Figure 16:
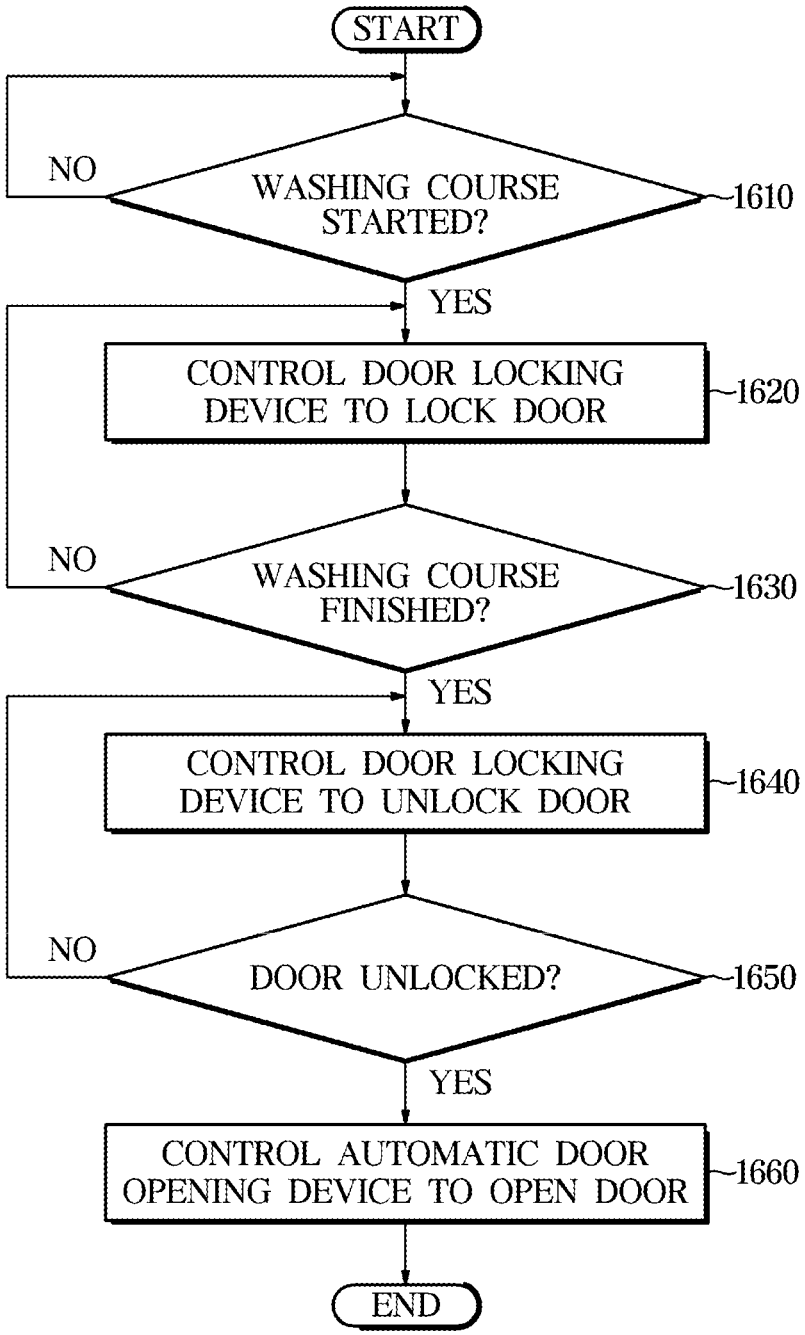
FIG. 16 is a flowchart of a case of opening a door after completion of a washing course in a method of controlling a washing machine, according to an embodiment of the disclosure.

FIG. 16 is a flowchart of a case of opening the door 20 after completion of a washing course in a method of controlling the washing machine 1, according to an embodiment of the disclosure.

Referring to FIG. 16, when a washing course is started in 1610, the washing machine 1 may control the door locking device 150 to lock the door 20 in 1620. In this case, the door locking device 150 may fix the locking member 155 with the locking bar 155*b* of the locking member 155 inserted to the locking hole 21*a* of the latch 21. Accordingly, the door 20 may be closed and locked during the washing course of the washing machine 1, thereby preventing the door 20 from being opened during the washing course.

When the washing course is finished in 1630, the washing machine 1 may control the door locking device 150 to unlock the door 20 in 1640. In this case, the door locking device 150 may unlock the locking member 155, so that the locking member 155 may be rotated by external pressure. The user may then open the door 20, or the door 20 may be opened by the automatic door opening device 160.

When the door 20 is unlocked in 1650, the washing machine 1 may control the automatic door opening device 160 to open the door 20 in 1660. In other words, the washing machine 1 may control the automatic door opening device 160 to open the door 20 by delivering driving power to the locking member 155 in response to unlocking of the door 20.

For example, when the washing machine 1 identifies based on an output of the lock detection sensor 135 that the door 20 is unlocked and identifies based on an output of the open/close detection sensor 130 that the door 20 is closed, the washing machine 1 may supply power to the driver 161. In other words, the washing machine 1 may control the automatic door opening device 160 to open the door 20 when the door 20 is unlocked but still closed after completion of washing based on outputs of the open/close detection sensor 130 and the lock detection sensor 135.

As such, the washing machine 1 may open the door 20 when the door 20 is not opened by the user after completion of a washing course, thereby preventing a bad smell from the laundry caused by residual moisture inside due to the closed state of the door 20.

Figure 17:
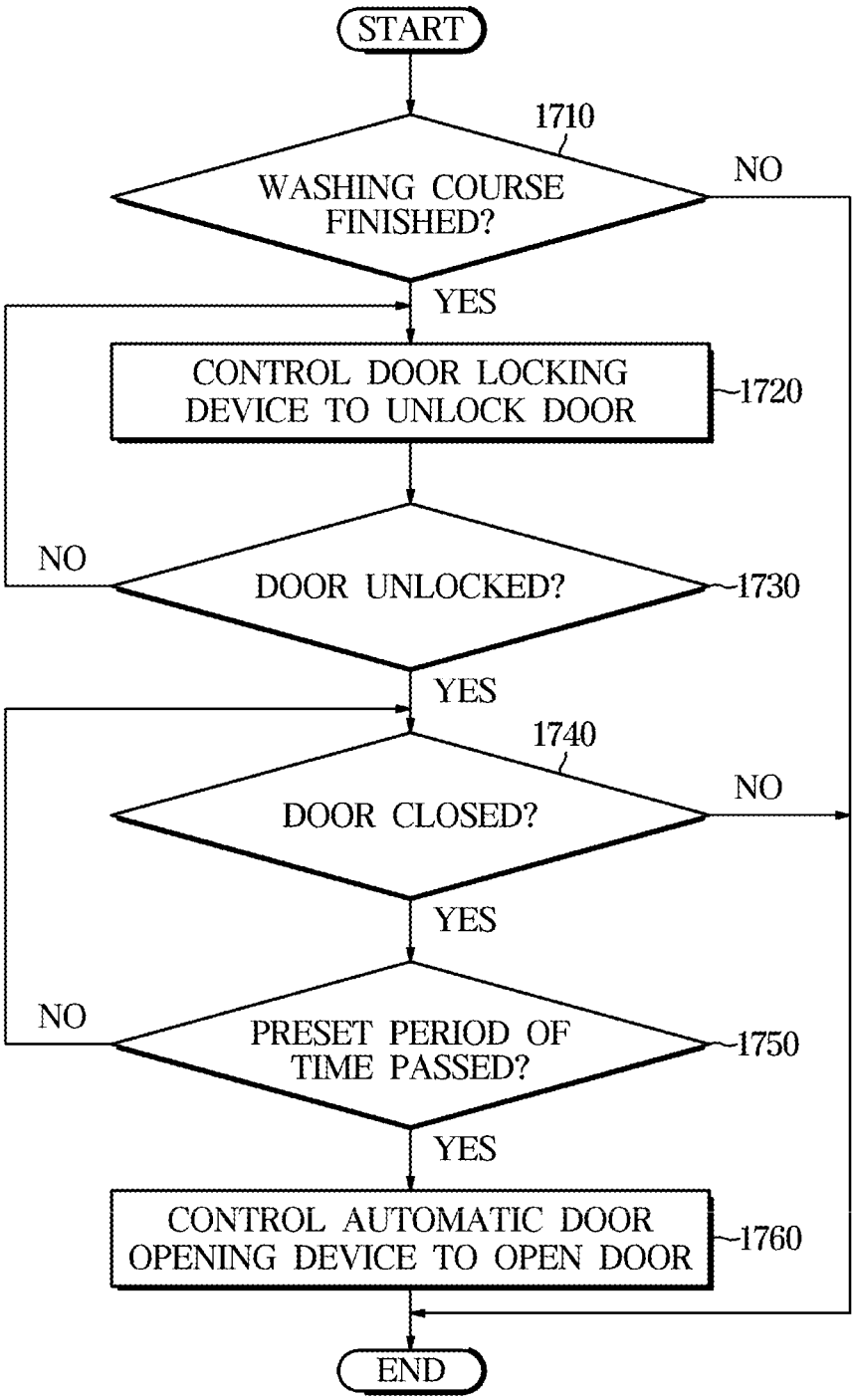
FIG. 17 is a flowchart of a case of opening a door when a preset period of time elapses after completion of a washing course in a method of controlling a washing machine, according to an embodiment of the disclosure.

FIG. 17 is a flowchart of a case of opening the door 20 when a preset period of time elapses after completion of a washing course in a method of controlling the washing machine 1, according to an embodiment of the disclosure.

Referring to FIG. 17, when a washing course is finished in 1710, the washing machine 1 may control the door locking device 150 to unlock the door 20 in 1720.

When the door 20 is unlocked in 1730 but closed in 1740, the washing machine 1 may control the automatic door opening device 160 to open the door 20 in 1760 after the lapse of a preset period time in 1750.

In other words, the washing machine 1 may control the automatic door opening device 160 to open the door 20 to prevent moisture inside from causing bad smell from the laundry in a case that the user has not opened the door 20 for a preset period of time after the washing course was finished.

For example, the washing machine 1 may control the door locking device 150 to unlock the door 20 by unfixing the locking member 155 in response to completion of the washing course, and control the automatic door opening device 160 to open the door 20 in response to the door 20 kept closed for a preset period of time after completion of the washing course.

Figure 18:
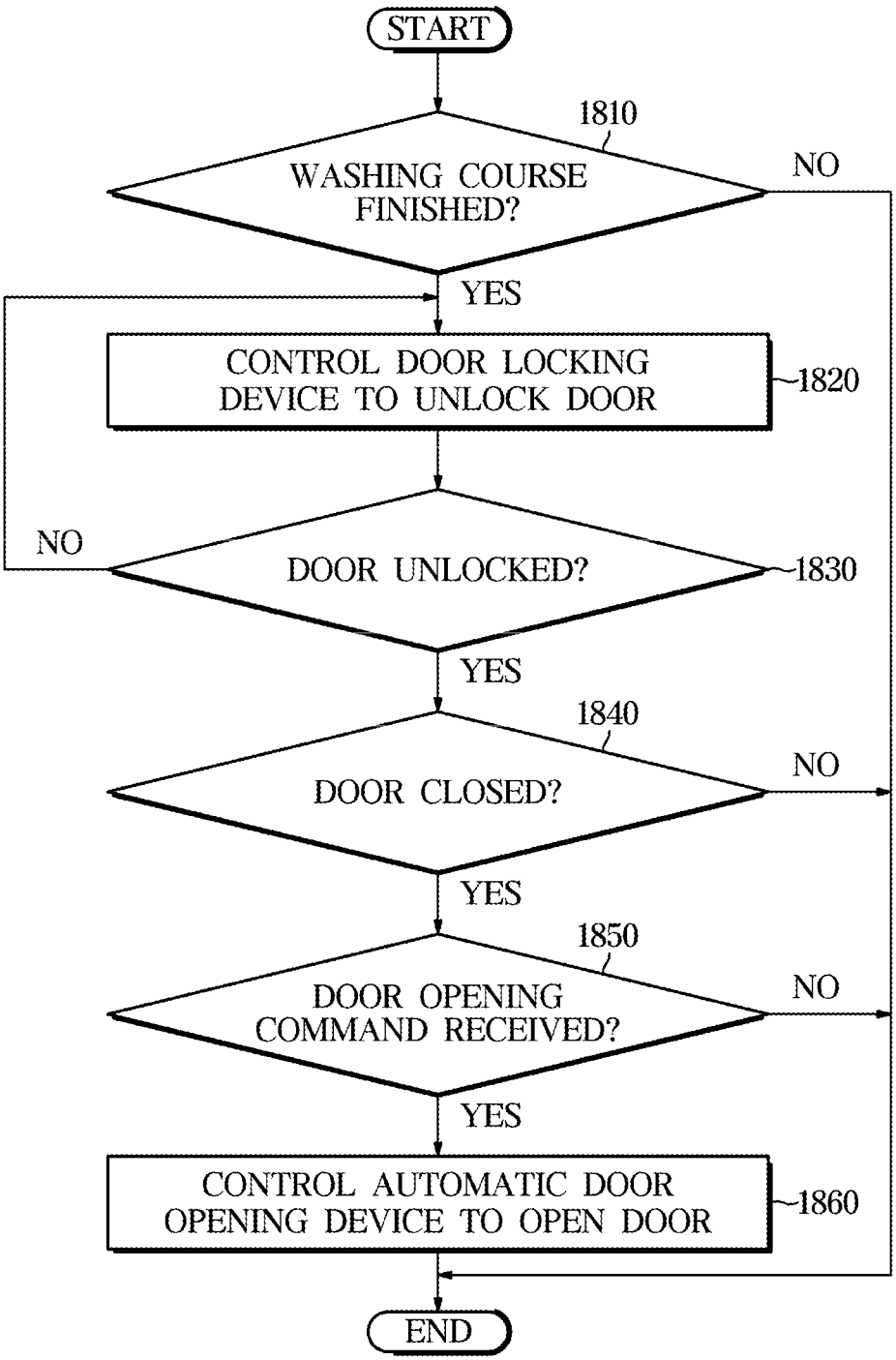
FIG. 18 is a flowchart of a case of opening a door when a command to open a door is received from an external terminal device after completion of a washing course in a method of controlling a washing machine, according to an embodiment of the disclosure.

FIG. 18 is a flowchart of a case of opening the door 20 when a command to open the door 20 is received from an external terminal device after completion of a washing course in a method of controlling the washing machine 1, according to an embodiment of the disclosure.

Referring to FIG. 18, when a washing course is finished in 1810, the washing machine 1 may control the door locking device 150 to unlock the door 20 in 1820.

Subsequently, when receiving a door opening command in 1850 when the door 20 is unlocked in 1830 in a closed state in 1840, the washing machine 1 may control the automatic door opening device 160 to open the door 20 in 1860.

For example, the washing machine 1 may control the automatic door opening device 160 to open the door 20 when receiving the door opening command from the user terminal after completion of a washing course, and accordingly, the user may remotely control the washing machine 1 to open the door 20 when a washing course is finished, thereby preventing a bad smell from the laundry caused by residual moisture due to the closed state of the door 20.

More specifically, the washing machine 1 may control the door locking device 150 to unlock the door 20 by unfixing the locking member 155 in response to completion of the washing course, and control the automatic door opening device 160 to open the door 20 in response to receiving the door opening command from the external terminal device.

Figure 19:
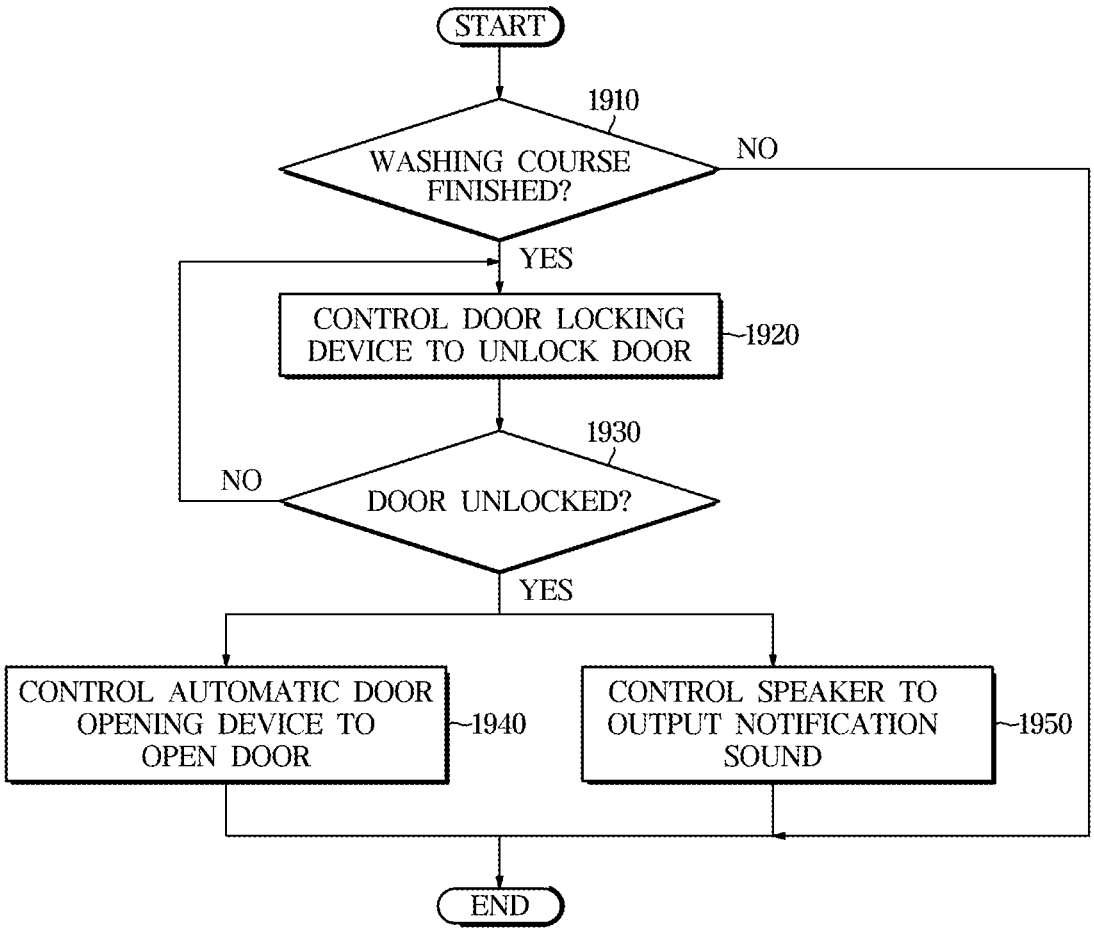
FIG. 19 is a flowchart of a case of outputting a notification sound when a door is opened in in a method of controlling a washing machine, according to an embodiment of the disclosure.

FIG. 19 is a flowchart of a case of outputting a notification sound when the door 20 is opened in in a method of controlling the washing machine 1, according to an embodiment of the disclosure.

Referring to FIG. 19, when a washing course is finished in 1910, the washing machine 1 may control the door locking device 150 to unlock the door 20 in 1920.

When the door 20 is unlocked in 1930, the washing machine 1 may control the automatic door opening device 160 to open the door 20 in 1940 and simultaneously control the speaker 170 to output a notification sound in 1950.

For example, the washing machine 1 may control the speaker 170 to output a notification sound while electric power is supplied to the driver 161 of the automatic door opening device 160, so that the notification sound may offset noise that may occur during the operation of opening the door 20 and simultaneously notify the user of completion of washing.

Meanwhile, the embodiments of the disclosure may be implemented in the form of a recording medium for storing instructions to be carried out by a computer. The instructions may be stored in the form of program codes, and when executed by a processor, may generate program modules to perform one or more operations to carry out the example embodiments of the disclosure. The recording media may correspond to computer-readable recording media, for example non-transitory computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

According to embodiments of the disclosure, a washing machine is provided to be able to automatically open a door after completion of a washing course to avoid the bad smell from the laundry due to moisture inside.

Example embodiments of the disclosure have been described above, but a person of ordinary skill in the art will understand and appreciate that various modifications can be made to these embodiments without departing from the scope of the disclosure. Thus, it will be apparent to those or ordinary skill in the art that the true scope of technical protection is defined by the following claims.

What is claimed is:

1. A washing machine, comprising:

a main body having an inlet;

a door configured to open and close to open or close the inlet, respectively, and including a latch with a locking hole formed in the latch;

a door locking device on the main body and including a locking member that is rotatable and that includes a locking bar, wherein the locking member is configured so that, with the door closed, the locking bar is insertable into the locking hole via rotation of the locking member to lock the door, and is removable from the locking hole via rotation of the locking member to unlock the door, and, as the locking bar is removed from the locking hole via rotation of the locking member, the locking member pushes the latch to cause the door to move away from the inlet and thereby open;

an automatic door opening device configured to, with the door closed and the locking bar inserted into the locking hole, generate a driving power based on electric power and deliver the driving power to the locking member to rotate the locking member so that the locking bar is removed from the locking hole; and a controller configured to, in response to a completion of a washing course with the door closed and the locking bar inserted into the locking hole, perform control so that the automatic door opening device generates the driving power based on the electric power and delivers the driving power to the locking member, to thereby automatically open the door in response to the completion of the washing course.

2. The washing machine of claim 1, wherein the controller is configured to perform control so that the automatic door opening device automatically opens the door by delivering the driving power to the locking member in response to a state in which the door is unlocked and closed.

3. The washing machine of claim 2, wherein the controller is configured to perform control so that the automatic door opening device automatically opens the door by delivering the driving power to the locking member in response to the door being kept in a closed state for a preset period of time after completion of the washing course.

4. The washing machine of claim 2, wherein the controller is configured to perform control to turn off the automatic door opening device in response to a state in which the locking bar is removed from the locking hole and the door is opened.

5. The washing machine of claim 4, wherein the automatic door opening device includes:

a driver configured to generate the driving power based on the electric power supplied to the driver, a link member moveable based on the driving power generated by the driver, a rotating gear that is rotatable based on movement of the link member and configured to deliver rotation power to the locking member, and a micro switch configured to detect a position of the link member, wherein the controller is configured to perform control to turn off the automatic door opening device by stopping supply of electric power to the driver in response to the link member being in a position where the locking bar is removed from the locking hole and the door being in an opened state.

6. The washing machine of claim 5, wherein the locking member includes a cam that is rotated by the rotation power delivered by the rotating gear, the locking bar protrudes from the cam, and the locking member further includes an auxiliary bar that protrudes from the cam and that pushes the latch as the locking bar is removed from the locking hole.

7. The washing machine of claim 2, wherein the controller is configured to perform control to turn off the automatic door opening device in response to passage of a preset period of time after starting to control the automatic door opening device.

8. The washing machine of claim 1, further comprising:

a communication module configured to communicate with an external terminal device, wherein the controller is configured to perform control so that the automatic door opening device opens the door by delivering the driving power to the locking member in response to receiving a command to open the door from the external terminal device after the completion of the washing course.

9. The washing machine of claim 1, further comprising:

an input module configured to receive a user input, wherein the controller is configured to perform control so that the automatic door opening device opens the door by delivering the driving power to the locking member after the completion of the washing course in response to a user input being entered to activate an automatic door opening function.

10. The washing machine of claim 1, further comprising:

a speaker, wherein the controller is configured to perform control so that the speaker outputs a notification sound while the automatic door opening device is operating.

11. The washing machine of claim 1, wherein the locking member includes an auxiliary bar that pushes the latch as the locking bar is removed from the locking hole, to cause the door to move away from the inlet and thereby open.

12. A washing machine, comprising:

a main body having an inlet;

a door configured to open and close to thereby open or close the inlet, respectively, and including a latch with a locking hole formed in the latch;

a door locking device on the main body and including a cam that is rotatable, a locking bar protruding from the cam and that, with the door closed, is insertable into the locking hole via rotation of the cam to lock the door, and that is removable from the locking hole via rotation of the cam to unlock the door, and an auxiliary bar protruding from the cam and that, as the locking bar is being removed from the locking hole via rotation of the cam, pushes the latch to cause the door to move away from the inlet and thereby open the inlet, and a controller configured to, in response to a completion of a washing course with the door closed and the locking bar inserted into the locking hole, perform control to automatically rotate the cam so that the locking bar is removed from the locking hole and, as the locking bar is removed from the locking hole, the auxiliary bar pushes the latch to cause the door to move away from the inlet and thereby automatically open in response to the completion of the washing course.

* * * * *